US011441759B2

(12) United States Patent
Shi et al.

(10) Patent No.: US 11,441,759 B2
(45) Date of Patent: Sep. 13, 2022

(54) LIGHTING DEVICE AND CEILING LIGHT

(71) Applicants: SUZHOU OPPLE LIGHTING CO., LTD., Suzhou (CN); OPPLE LIGHTING CO., LTD., Shanghai (CN)

(72) Inventors: Xiufeng Shi, Suzhou (CN); Jianguo Li, Suzhou (CN); Song Yin, Suzhou (CN); Chongchong Li, Suzhou (CN)

(73) Assignees: Suzhou Opple Lighting Co., Ltd., Suzhou (CN); Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 17/477,457

(22) Filed: Sep. 16, 2021

(65) Prior Publication Data

US 2022/0003391 A1 Jan. 6, 2022

Related U.S. Application Data

(63) Continuation of application No. PCT/CN2020/080266, filed on Mar. 19, 2020.

(30) Foreign Application Priority Data

Mar. 20, 2019 (CN) ..... 201910211612.8
Mar. 20, 2019 (CN) ..... 201920354548.4

(51) Int. Cl.
*F21V 21/03* (2006.01)
*F21V 29/503* (2015.01)
(Continued)

(52) U.S. Cl.
CPC ..... *F21V 21/03* (2013.01); *F21V 23/02* (2013.01); *F21V 23/06* (2013.01); *F21V 29/503* (2015.01); *F21Y 2115/10* (2016.08)

(58) Field of Classification Search
CPC ..... F21V 23/06; F21V 21/03; F21V 15/01
See application file for complete search history.

(56) References Cited

U.S. PATENT DOCUMENTS

2005/0248938 A1* 11/2005 Lin ..... G02F 1/133608 362/225
2009/0168439 A1* 7/2009 Chiang ..... F21V 19/003 362/404

(Continued)

FOREIGN PATENT DOCUMENTS

CN 205579359 U 9/2016
CN 205896732 U 1/2017

(Continued)

OTHER PUBLICATIONS

International Search Report of PCT Application No. PCT/CN2020/080266 dated Jun. 15, 2020 with English translation, (4p).

*Primary Examiner* — Evan P Dzierzynski
(74) *Attorney, Agent, or Firm* — Arch & Lake LLP

(57) ABSTRACT

The present disclosure discloses a lighting device and a ceiling light, the lighting device includes: a chassis, at least one lighting module, a drive power supply, and a first mounting component; the lighting module and the drive power supply are arranged on the chassis; the first mounting component is configured to mount the lighting module and the drive power supply on the chassis in a covering mode, the first mounting component includes a main body unit, at least one first accommodating part, and at least one second accommodating part, the first accommodating part and the second accommodating part are both arranged on the main body unit; and one end of the lighting module is electrically connected in the first accommodating part, one end of the drive power supply is connected in the second accommodating part, and the drive power supply supplies power to the lighting module.

18 Claims, 5 Drawing Sheets

(51) Int. Cl.

| | |
|---|---|
| ***F21V 23/02*** | (2006.01) |
| ***F21V 23/06*** | (2006.01) |
| *F21Y 115/10* | (2016.01) |

(56) References Cited

U.S. PATENT DOCUMENTS

2009/0316395 A1* 12/2009 Xiao ..... F21S 8/086
362/234
2011/0025928 A1* 2/2011 Yokota ..... G02F 1/133604
348/739

FOREIGN PATENT DOCUMENTS

CN 205896939 U 1/2017
CN 207298664 U 5/2018
CN 109812743 A 5/2019

* cited by examiner

LIGHTING DEVICE AND CEILING LIGHT

CROSS REFERENCE TO RELATED APPLICATIONS

This application is based upon and claims the priority of PCT patent application No. PCT/CN2020/080266 filed on Mar. 19, 2020 which claims priority of Chinese Patent Application No. 201910211612.8 filed on Mar. 20, 2019, and Chinese Patent Application No. 201920354548.4 filed on Mar. 20, 2019, the entire disclosures of these applications are incorporated herein by reference in their entirety for all purposes.

TECHNICAL FIELD

The present disclosure relates to the technical field of lighting, and in particular to a lighting device and a ceiling light.

BACKGROUND

In the field of lighting, a ceiling light or a light-emitting diode (LED) direct-type panel lamp is a widely used lamp.

Sometimes, an LED ceiling light on the domestic market and the foreign market may adopt a solution of exposing a light source and an electric wire, and is simple and crude in appearance.

SUMMARY

The examples of the present disclosure provides a lighting device, a ceiling light and a method of manufacturing a lighting device.

In a first aspect, an example of the present disclosure provides a lighting device. The device may include a chassis, at least one lighting module, a drive power supply, and a first mounting component.

The lighting module and the drive power supply may be arranged on the chassis; the first mounting component may be configured to mount the lighting module and the drive power supply on the chassis in a covering mode, the first mounting component may include a main body unit, at least one first accommodating part, and at least one second accommodating part, and the first accommodating part and the second accommodating part may be arranged on the main body unit; and one end of the lighting module may be electrically connected in the first accommodating part, one end of the drive power supply may be connected in the second accommodating part, and the drive power supply may supply power to the lighting module.

In a second aspect, the present disclosure provides a ceiling light. The ceiling light may include a lighting device and a mounting element for mounting the lighting device under a roof.

The lighting device may include a chassis, at least one lighting module, a drive power supply, and a first mounting component. The lighting module and the drive power supply may be arranged on the chassis; the first mounting component may be configured to mount the lighting module and the drive power supply on the chassis in a covering mode, the first mounting component may include a main body unit, at least one first accommodating part, and at least one second accommodating part, and the first accommodating part and the second accommodating part may be arranged on the main body unit; and one end of the lighting module may be electrically connected in the first accommodating part, one end of the drive power supply may be connected in the second accommodating part, and the drive power supply may supply power to the lighting module.

In a third aspect, the present disclosure provides a method of manufacturing a lighting device. The method may include: providing a chassis, at least one lighting module, a drive power supply, and a first mounting component; arranging the lighting module and the drive power supply on the chassis; configuring the first mounting component to mount the lighting module and the drive power supply on the chassis in a covering mode; providing the first mounting component with a main body unit, at least one first accommodating part, and at least one second accommodating part; arranging the first accommodating part and the second accommodating part on the main body unit; electrically connecting one end of the lighting module in the first accommodating part; connecting one end of the drive power supply in the second accommodating part; and supplying, by the drive power supply, power to the lighting module.

It is to be understood that both the foregoing general description and the following detailed description are exemplary and explanatory only and are not restrictive of the present disclosure.

BRIEF DESCRIPTION OF THE DRAWINGS

The accompanying drawings described here are intended to provide a further understanding of the present disclosure and constitute a part of the present disclosure. The illustrative examples of the present disclosure and descriptions thereof are intended to explain the present disclosure and are not intended to constitute an improper limitation on the present disclosure. In the drawings.

DETAILED DESCRIPTION

Figure 1:
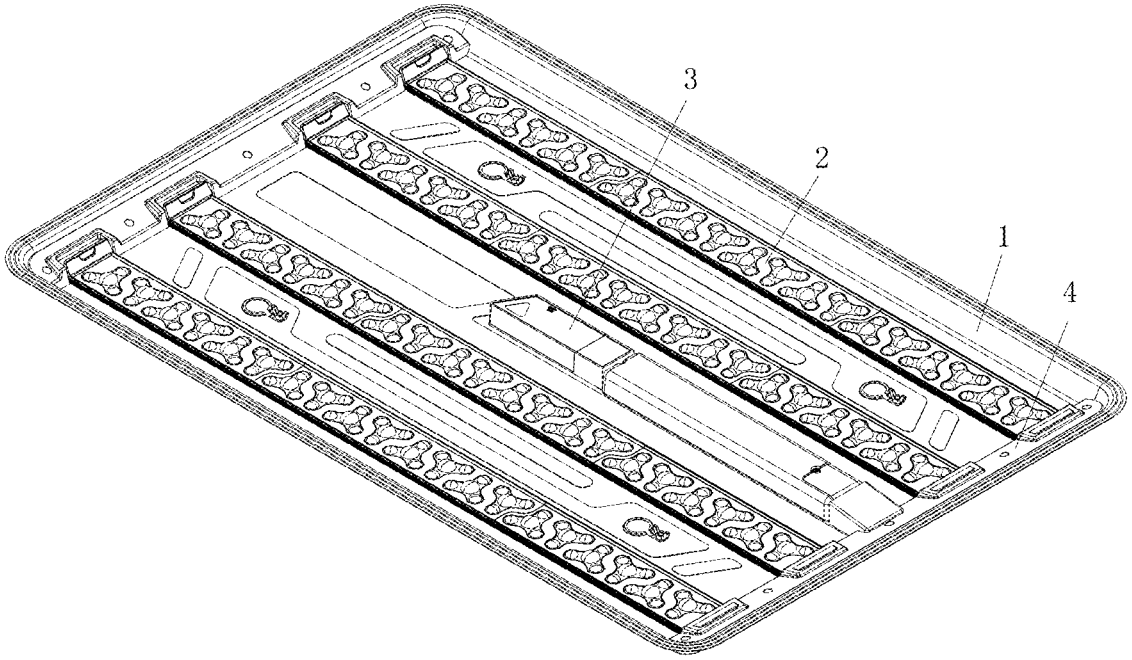
FIG. 1 is a structural schematic diagram of one example of a lighting device of the present disclosure.

In order to make objects, technical solutions, and advantages of the examples of the present disclosure more apparent, the technical solutions of the present disclosure will be described in a clearly and completely way below in connection with the specific examples of the present disclosure and the corresponding drawings. Apparently, the described examples are just a part but not all of the examples of the present disclosure. Based on the examples of the present disclosure, those skilled in the art can obtain other example(s), without any inventive work, which should be within the scope of the present disclosure.

Reference numerals in this disclosure may include:

chassis 1, lighting module 2, conductive terminal 21, light source plate 22, panel 231, lens 232, a first lens element 2321, second lens element 2322, light-through hole 233, first groove 234, second protrusion 235, conductive hole 237, first cavity 24, heat dissipation element 25, drive power supply 3, first mounting component 4, main body unit 41, first accommodating part 42, second accommodating part 43, conversion circuit module 44, second mounting component 5, elastic part 51, sliding block 511, spring 512, first protrusion 513, press fit part 514, pressing-down plate 515, mounting element 6, and shell 7.

The technical solutions provided by various examples of the present disclosure are described in detail below with reference to the accompanying drawings.

As shown in FIG. 1, an example of the present disclosure provides a lighting device, including: a chassis 1, at least one lighting module 2, a drive power supply 3, and at least one first mounting component 4; the lighting module 2 and the drive power supply 3 are arranged on the chassis 1; the first mounting component 4 is configured to mount the lighting module 2 and the drive power supply 3 on the chassis 1 in a covering mode, the first mounting component 4 includes a main body unit 41, at least one first accommodating part 42, and at least one second accommodating part 43, and the first accommodating part 42 and the second accommodating part 43 are both arranged on the main body unit 41; and one end of the lighting module 2 is electrically connected in the first accommodating part 42, one end of the drive power supply 3 is connected in the second accommodating part 43, and the drive power supply 3 supplies power to the lighting module 2.

According to the present disclosure, the lighting module 2 and the drive power supply 3 are connected to the first mounting component 4, the first mounting component achieves that the drive power supply 3 supplies power to the lighting module 2 without providing additional wiring on the lighting module, and the connection is simpler, safe and reliable.

Figure 2:
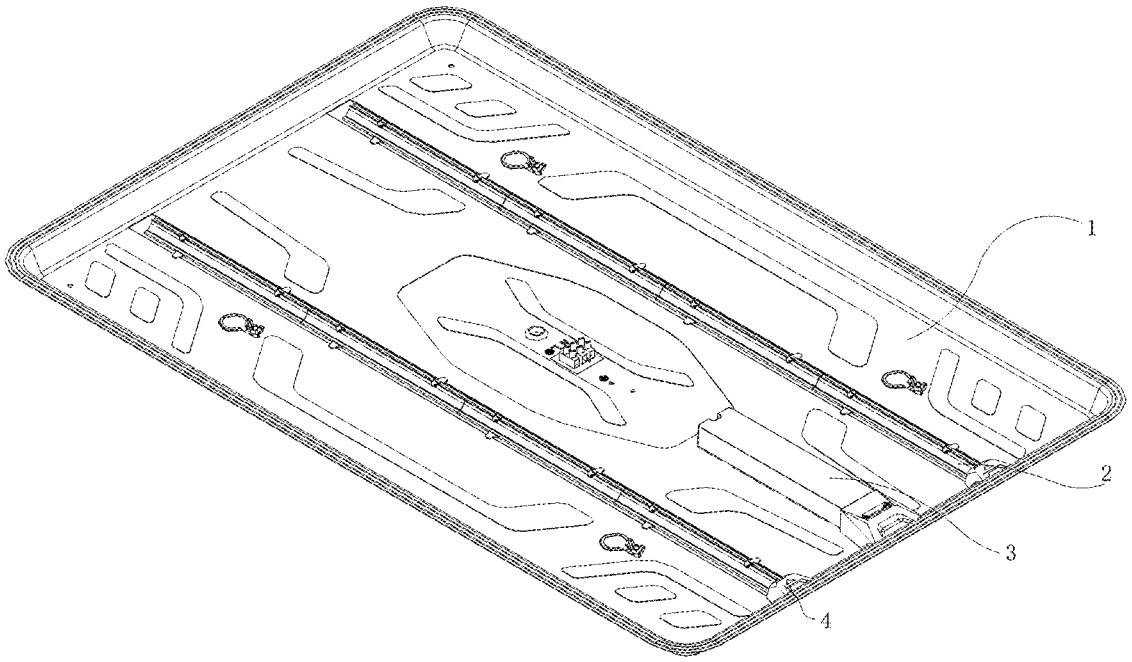
FIG. 2 is a structural schematic diagram of another example of a lighting device of the present disclosure.

In one example of the present disclosure, the lighting module 2 is a strip-shaped module, there are at least two lighting modules 2, and the lighting modules 2 and the drive power supply 3 are arranged in parallel on the chassis 1. Being arranged in parallel improves the uniformity of dispersing the lighting light. Preferably, the drive power supply 3 is arranged between the lighting modules 2; for example: (1) as shown in FIG. 2, there are two lighting modules 2, and taking the drive power supply 3 as an axis of symmetry, the two lighting modules 2 are respectively arranged on two sides of the drive power supply 3; (2) as shown in FIG. 1, there are four lighting modules 2, and taking the drive power supply 3 as an axis of symmetry, two lighting modules 2 are arranged on each of the two sides of the drive power supply 3; in this way, the drive power supply 3 is more convenient to supply power to the lighting module 2, the turn-on time of the lighting modules 2 on the two sides of the drive power supply 3 is the same, and the lighting light is uniform.

Figure 3:
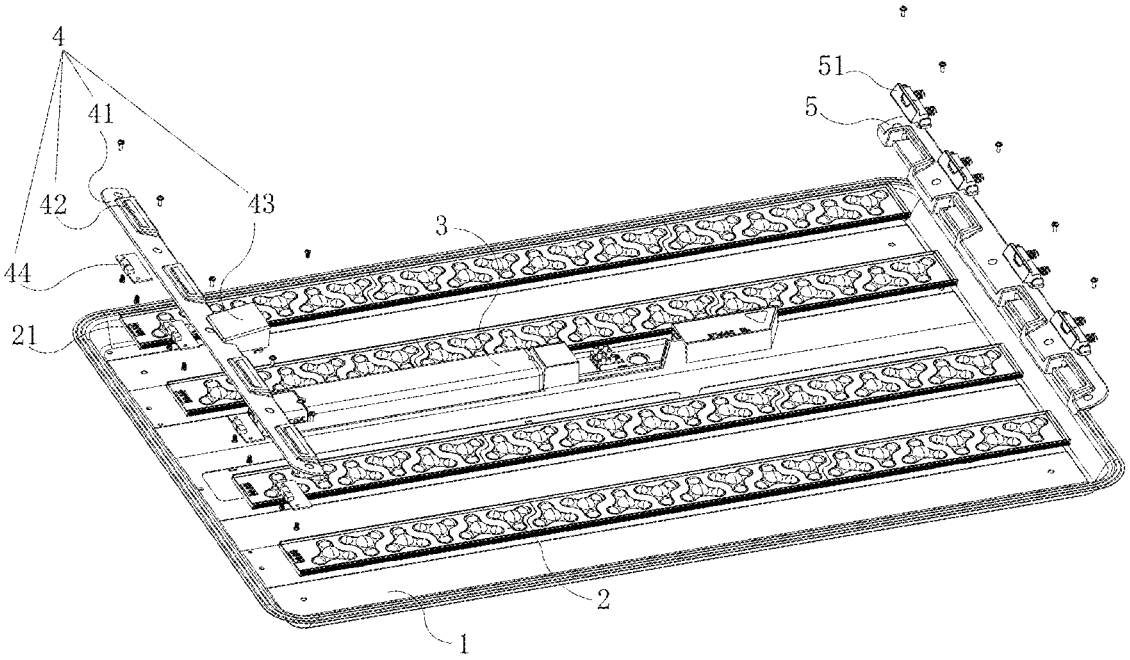
FIG. 3 is a schematic diagram of an exploded structure of FIG. 1.

In one example of the present disclosure, as shown in FIG. 3, the first mounting component 4 includes a main body unit 41, a first accommodating part 42, a second accommodating part 43, and a conversion circuit module 44; the first accommodating part 42 and the second accommodating part 43 are arranged on the main body unit 41; the number of the conversion circuit modules 44 is the same as that of the lighting modules 2; the conversion circuit module 44 is arranged in the first accommodating part 42, a conductive terminal 21 is arranged at one end of the lighting module 2, and the conversion circuit module 44 is electrically connected with the conductive terminal 21; one end of the drive power supply 3 is electrically connected in the second accommodating part 42. Such arrangement further reduces the connection between the wires, the exposure of the wire is avoided, and the aesthetics of the appearance is improved. Preferably, the conductive terminal 21 is a patch terminal, and the patch terminal is in contact and electrically connected with a metal conductive contact on the conversion circuit module 44. Through connecting the patch terminal to the contact, rather than a fixed connection or a wire plug connection, the mounting is simpler, and the design is more beautiful.

Figure 4:
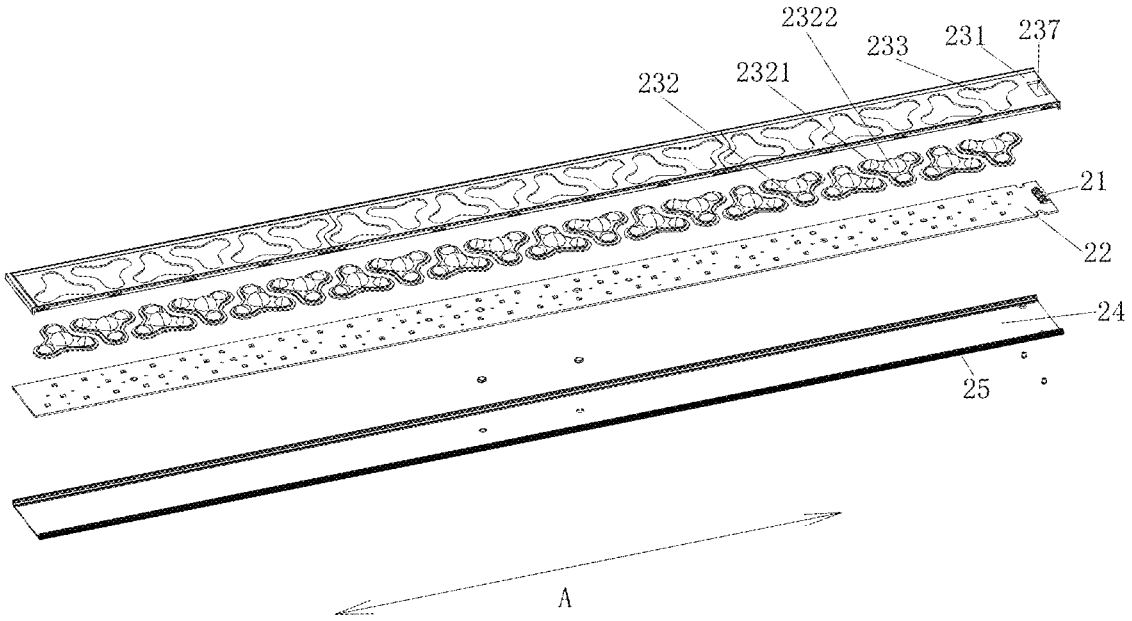
FIG. 4 is a schematic diagram of an exploded structure of a lighting module.

In one example of the present disclosure, as shown in FIG. 4, there are at least two lighting modules 2, and each lighting module 2 includes: a light source plate 22, a lens 232, and a panel 231; along a direction from the chassis 1 to the light source plate 22, at least one light source is electrically connected with the light source plate 22; along the direction from the chassis 1 to the light source plate 22, the lens 232 is covered on the light source; a light-through hole 233 is arranged on the panel 231, the lens 232 is arranged in the light-through hole 233, and the panel 231 is used for fixing the lens 232 on the light source plate 22; the conductive terminal 21 is arranged at one end of the light source plate 22; and a conductive hole 237 is arranged on the panel 231, and the conductive terminal 21 passes through the conductive hole 237 and is electrically connected with the conversion circuit module 44.

In one example of the present disclosure, the conductive terminal 21 is a copper elastic sheet, a metal contact is arranged on the conversion circuit module 44, and the copper elastic sheet is electrically connected with the metal contact. Compared with a plug type electrical connection mode, in such arrangement, the mounting is simpler and it is convenient to disassemble.

In one example of the present disclosure, as shown in FIG. 4, the lens 232 includes a first lens element 2321 and three second lens elements 2322, and the other three second lens elements 2322 are arranged in a circular array around the first lens element 2321 by taking the first lens element 2321 as the center of a circle. Light sources are respectively arranged below both the first lens element 2321 and the second lens element 2322. In one example of the present disclosure, the light source adopts an LED lamp, preferably, three LED lamps arranged below the second lens elements 2322 adopt yellow light lamps, and the LED lamp arranged below the first lens element 2321 adopts a white light lamp; and because the yellow light lamp is more energy-saving and is higher in economic efficiency than the white light lamp, the LED lamps of the above arrangement not only meets the requirement of energy-saving, but also meets the requirement of lighting intensity, and is more economical. Preferably, as shown in FIG. 4, there are two or more lenses 232, and along an extension direction (that is, a direction A) of the lighting module 2, two adjacent lenses 232 are arranged symmetrically at 180 degrees. Such arrangement ensures the uniformity of the light source, and avoids the problem that the illumination of a certain part is too strong or too weak.

In one example of the present disclosure, as shown in FIG. 4, the lighting module 2 further includes: a heat dissipation element 25, the light source plate 22 is arranged on the heat dissipation element 25, and the heat dissipation element 25 is arranged on the chassis 1. Preferably, the heat dissipation element 25 is made of an aluminum plate, which has the characteristics of high heat dissipation performance and high economic efficiency.

The panel 231 and the heat dissipation element 25 form a first cavity 24, and the light source module 2 is disposed in the first cavity 24. Preferably, if there are two or more lighting modules 2, the panel 231 may be an integral body, a plurality of first cavities 24 are arranged on the integral body, each first cavity 24 is used for mounting one lighting module 2, and the panel 231 adopts an integral design and has the characteristic of simple process; or the number of the panels 231 is the same as that of the lighting modules 2, each panel 231 is provided with one first cavity 24, one lighting module 2 is arranged in each first cavity 24, and the panels 231 adopt a plurality of independent designs and have the characteristic of simple mounting.

In one example of the present disclosure, as shown in FIG. 3, at least one second mounting component 5 connected with the panel 231 is further included, and the second mounting component 5 is used for fixing the other end of the lighting module 2.

The second mounting component 5 may be of an integral structure, that is, there is one second mounting component 5, and the lighting module 2 is connected to the second mounting component 5.

The second mounting component 5 may be of a split structure, that is, the number of the second mounting components 5 is smaller than or equal to the number of the lighting modules 2, and each second mounting component 5 is used for connecting one or more lighting modules 2.

In one example of the present disclosure, as shown in FIG. 4, an elastic part 51 is arranged inside the second mounting component 5, and the other end of the panel 231 presses the lighting module 2 on the chassis 1 through the elastic part 51. Preferably, the number of the elastic parts 51 is the same as the number of the lighting modules 2. The elastic part 51 has the characteristics of convenient mounting and tight connection.

In one example of the present disclosure, the second mounting component 5 adopts the following two modes.

Figure 6:
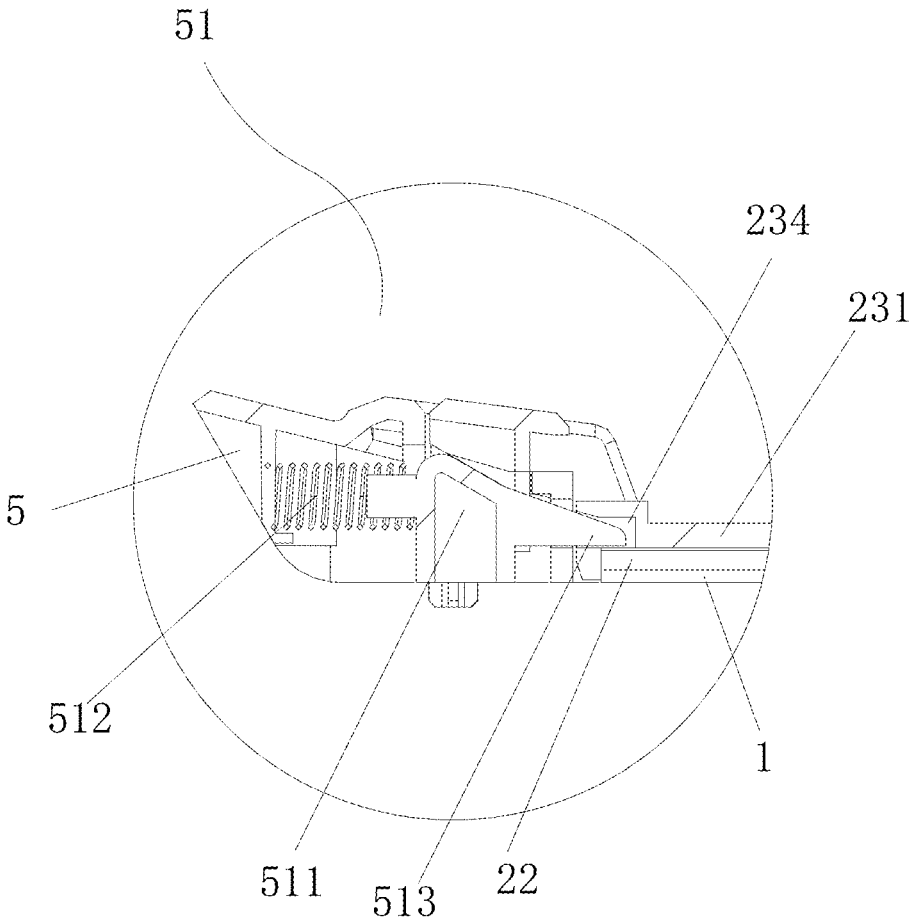
FIG. 6 is a partial structural schematic diagram after a second mounting component and a lighting module in a circular region of FIG. 5 are connected.

A first mode is as follows that: as shown in FIG. 6, the elastic part 51 includes a sliding block 511 and a spring 512, one end of the spring 512 is arranged on the second mounting component 5, and the other end of the spring 512 is arranged on the sliding block 511; in a direction away from the spring 512, at least one first protrusion 513 is arranged on one side of the sliding block 511, at least one first groove 234 is arranged on one end of the panel 231, and the first protrusion 513 is inserted into the first groove 234. Preferably, the number of the first protrusions 513 is two. In a case where the spring 512 is stretched along the second mounting component 5 towards the first mounting component 4, the first protrusion 213 is inserted into the first groove 234 under the pressure of the spring 512, and then the second mounting component 5 presses the lighting module 2 on the chassis 1, thereby limiting the movement of the lighting module 2 along the direction from the chassis 1 to the second mounting component 5; and in a case where the spring 512 is compressed along the first mounting component 4 towards the second mounting component 5, the first projection 213 is disengaged from the first groove 234, and the lighting module 2 can be detached from the elastic part 51. Such arrangement has the characteristics of simple mounting, flexibility and convenience, and can meet a requirement of various lighting module dimensions.

Figure 7:
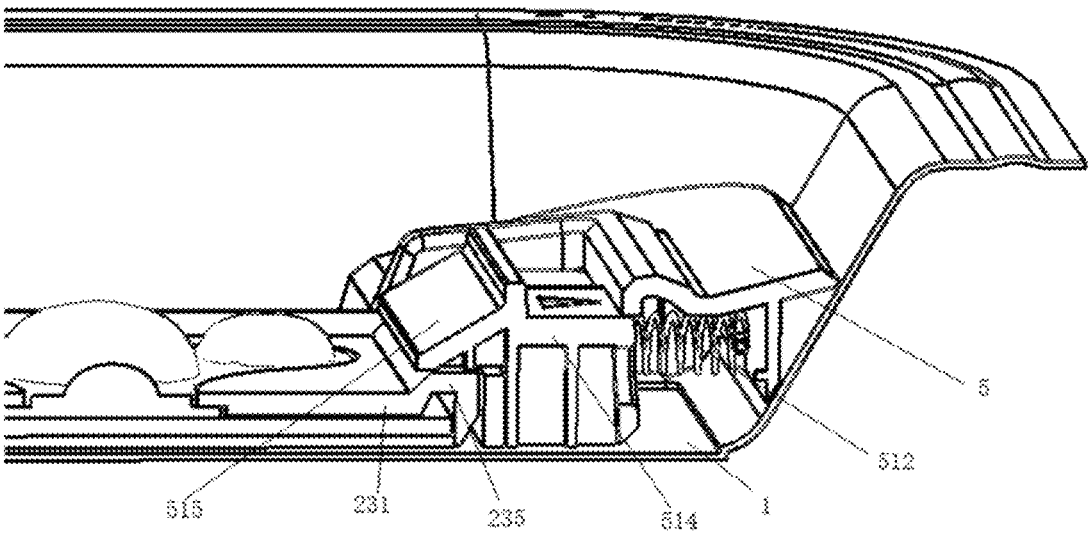
FIG. 7 is a partial structural schematic diagram of another example of a second mounting component and a panel.

A second mode is as follows that: as shown in FIG. 7, the elastic part 51 includes a press fit part 514 and a spring 512, one end of the spring 512 is arranged on the second mounting component 5, and the other end of the spring 512 is arranged on the press fit part 514; and in a direction away from the spring 512, a pressing-down plate 515 is arranged on one side of the press fit part 514, a second protrusion 235 is arranged on one end of the panel 231, and the pressing-down plate 515 is pressed on the second protrusion 235. In a case where the spring 512 is stretched along the second mounting component 5 towards the first mounting component 4, the second protrusion 235 abuts on the pressing-down plate 515 under the pressure of the spring 512, thereby limiting the movement of the lighting module 2 along the direction from the chassis 1 to the second mounting component 5; and in a case where the spring 512 is compressed along the first mounting component 4 towards the second mounting component 5, the second projection 235 is disengaged from the pressing-down plate 515, and the lighting module 2 can be detached from the elastic part 51. Such arrangement has the characteristic of tight connection.

Both the above two modes are examples only and other achievable implementations all fall within the protection scope of the present disclosure.

Figure 5:
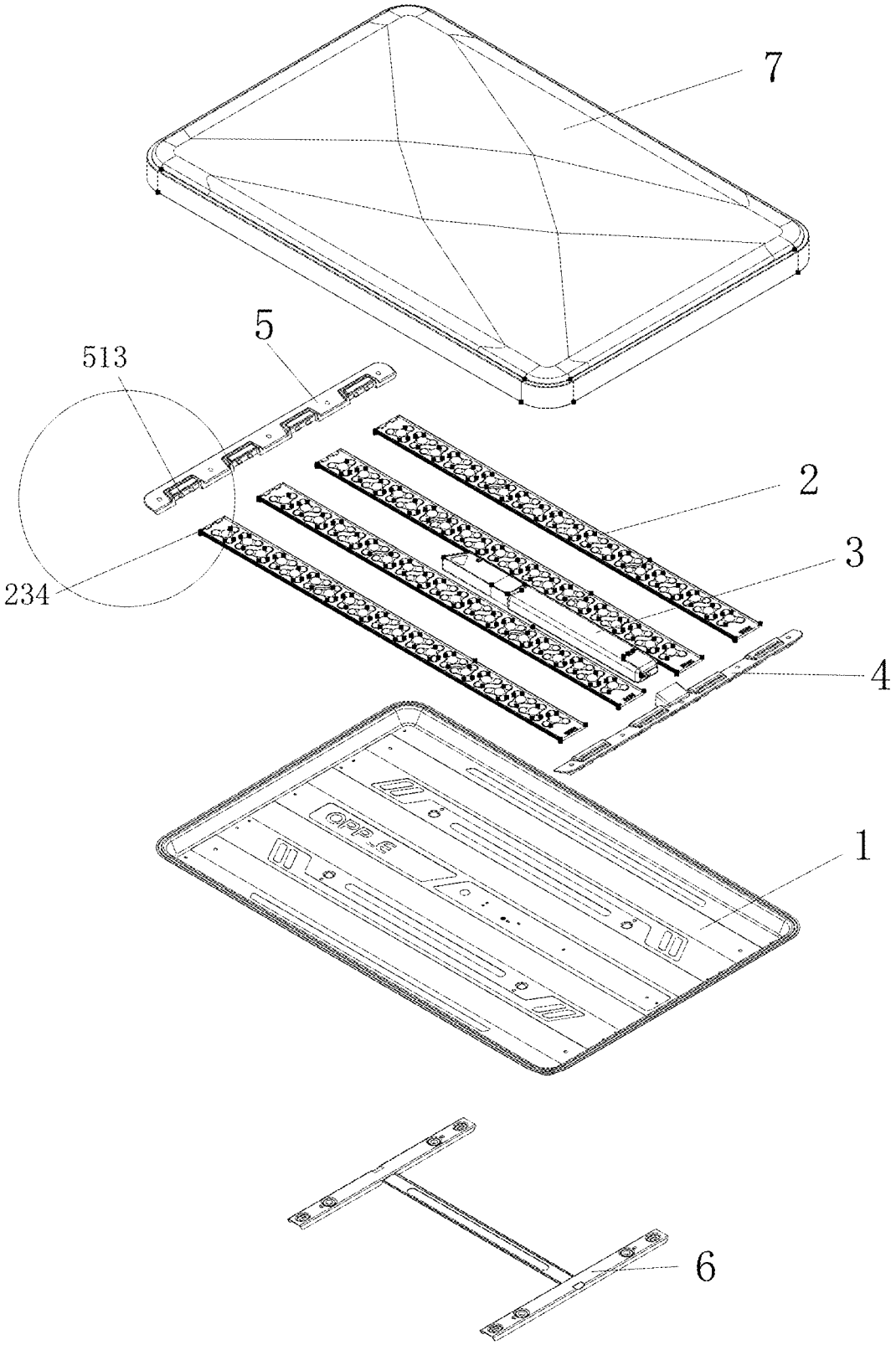
FIG. 5 is a structural schematic diagram of a ceiling light.

The present disclosure provides a ceiling light, as shown in FIG. 5, including the lighting device of any one of the above-mentioned examples and a mounting element 6 for mounting the lighting device to a roof.

Along a direction away from the lighting module 2, the mounting element 6 is arranged on the chassis 1.

The mounting element may be a hanging plate assembly or an adsorption element. Preferably, the adsorption element is a magnet. In the present disclosure, the lighting device is adsorbed under the roof through the adsorption element, or/and the lighting device is fixed under the roof through the hanging plate assembly, so that the mounting is simpler and the applicability is higher.

Further, as shown in FIG. 5, the ceiling light further includes: a shell 7, the shell 7 is covered the chassis 1, a cavity is formed between the shell 7 and the chassis 1, and the lighting module 2 and the drive power supply 3 are arranged in the cavity.

The examples of the present disclosure provides a lighting device, a ceiling light and a method of manufacturing a lighting device.

In a first aspect, an example of the present disclosure provides a lighting device, which may include: a chassis, at least one lighting module, a drive power supply, and a first mounting component;

the lighting module and the drive power supply are arranged on the chassis;

the first mounting component is configured to mount the lighting module and the drive power supply on the chassis in a covering mode, the first mounting component comprises a main body unit, at least one first accommodating part, and at least one second accommodating part, and the first accommodating part and the second accommodating part are both arranged on the main body unit; and one end of the lighting module is electrically connected in the first accommodating part, one end of the drive power supply is connected in the second accommodating part, and the drive power supply supplies power to the lighting module.

Optionally, in the above-mentioned lighting device, the lighting module is a strip-shaped module, there are at least two lighting modules, and the lighting modules and the drive power supply are arranged in parallel on the chassis.

Optionally, in the above-mentioned lighting device, each first accommodating part is provided with a conversion circuit module; and each conversion circuit module is connected with the drive power supply, a conductive terminal is arranged at one end of the lighting module, and the conversion circuit module is electrically connected with the conductive terminal.

Optionally, in the above-mentioned lighting device, each lighting module comprises: a light source plate, a lens, and a panel;

along a direction from the chassis to the light source plate, at least one light source is electrically connected with the light source plate;

along the direction from the chassis to the light source plate, the lens is covered on the light source;

a light-through hole is arranged on the panel, the lens is arranged in the light-through hole, and the panel is used for fixing the lens on the light source plate; the conductive terminal is arranged at one end of the light source plate; and a conductive hole is arranged on the panel, and the conductive terminal passes through the conductive hole and is electrically connected with the conversion circuit module.

Optionally, in the above-mentioned lighting device, the lens comprises a first lens element and three second lens elements, the three second lens elements are arranged in a circular array around the first lens element by taking the first lens element as a center of a circle, and light sources are respectively arranged on the light source plate below the first lens element and the three second lens elements; or/and there are two or more lenses, along an extension direction of the lighting module, two adjacent lenses are arranged symmetrically at 180 degrees.

Optionally, in the above-mentioned lighting device, the conductive terminal is a copper elastic sheet, a metal contact is arranged on the conversion circuit module, and the copper elastic sheet is electrically connected with the metal contact.

Optionally, in the above-mentioned lighting device, the lighting module further comprises: a heat dissipation element, the light source plate is arranged on the heat dissipation element, and the heat dissipation element is arranged on the chassis.

Optionally, the above-mentioned lighting device further comprises: at least one second mounting component connected with the panel, the second mounting component is used for fixing the other end of the lighting module.

Optionally, in the above-mentioned lighting device, an elastic part is arranged inside the second mounting component, and the other end of the panel presses the lighting module on the chassis through the elastic part.

Optionally, in the above-mentioned lighting device, the elastic part comprises a sliding block and a spring, one end of the spring is arranged on the second mounting component, and the other end of the spring is arranged on the sliding block; in a direction away from the spring, at least one first protrusion is arranged on one side of the sliding block, at least one first groove is arranged on one end of the panel, and the first protrusion is inserted into the first groove.

Optionally, in the above-mentioned lighting device, the elastic part comprises a press fit part and a spring, one end of the spring is arranged on the second mounting component, and the other end of the spring is arranged on the press fit part; and in a direction away from the spring, a pressing-down plate is arranged on one side of the press fit part, a second protrusion is arranged on one end of the panel, and the pressing-down plate is pressed on the second protrusion.

Optionally, in the above-mentioned lighting device, a second groove and a rotary pressing part are arranged on the second mounting component, a third protrusion is arranged on the other end of the lighting module, the third protrusion is inserted into the second groove in an interference fit mode, and the rotary pressing part is pressed on the third protrusion.

In a second aspect, the present disclosure provides a ceiling light, comprising the lighting device described in any one of the above examples and a mounting element for mounting the lighting device under a roof.

Optionally, the above-mentioned ceiling light further comprises: a shell, the shell is covered on the chassis, a cavity is formed between the shell and the chassis, and the lighting module and the drive power supply are arranged in the cavity.

In a third aspect, a method of manufacturing a lighting device is provided. The method may include: providing a chassis, at least one lighting module, a drive power supply, and a first mounting component; arranging the lighting module and the drive power supply on the chassis; configuring the first mounting component to mount the lighting module and the drive power supply on the chassis in a covering mode; providing the first mounting component with a main body unit, at least one first accommodating part, and at least one second accommodating part; arranging the first accommodating part and the second accommodating part on the main body unit; electrically connecting one end of the lighting module in the first accommodating part; connecting one end of the drive power supply in the second accommodating part; and supplying, by the drive power supply, power to the lighting module.

The method may also include providing lighting module that a strip-shaped module, and arranging at least two lighting modules, the lighting modules and the drive power supply in parallel on the chassis.

The method may include providing each first accommodating part with a conversion circuit module; connecting each conversion circuit module with the drive power supply; arranging a conductive terminal at one end of the lighting module, and electrically connecting the conversion circuit module with the conductive terminal.

The method may include providing each lighting module with a light source plate, a lens, and a panel; along a direction from the chassis to the light source plate, electrically connecting at least one light source with the light source plate; along the direction from the chassis to the light source plate, covering the lens on the light source; and arranging a light-through hole on the panel, arranging the lens in the light-through hole, and using the panel for fixing the lens on the light source plate; arranging the conductive terminal at one end of the light source plate; and arranging a conductive hole on the panel, and providing the conductive terminal to pass through the conductive hole and electrically connecting the conductive terminal with the conversion circuit module.

The at least one technical solution adopted by the examples of the present disclosure above can achieve the following beneficial effects:

the examples of the present disclosure disclose a lighting device, the first mounting component is arranged on the chassis, and the lighting module and the drive power supply are electrically connected in the first mounting component, so that the problems of electric wire exposure and simple and crude appearance are avoided, the safety of the lighting device is improved, and the appearance is tidy.

The present disclosure may include dedicated hardware implementations such as disclosure specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The above embodiments of the present disclosure focus on the differences among the various embodiments, as long as there is no contradiction, different optimization features among the various embodiments may be combined to form a more preferred embodiment, and in view of the conciseness of the text, the description will not be repeated here.

The above descriptions are embodiments of the present disclosure only and are not intended to limit the present disclosure. Various modifications and alterations of the present disclosure will occur to those skilled in the art. Any modifications, equivalents, improvements, and the like made within the spirit and principles of the present disclosure should be included within the scope of the present disclosure.

The invention claimed is:

1. A lighting device, comprising: a chassis, at least one lighting module, a drive power supply, and a first mounting component; wherein:

the lighting module and the drive power supply are arranged on the chassis;

the first mounting component is configured to mount the lighting module and the drive power supply on the chassis in a covering mode, the first mounting component comprises a main body unit, at least one first accommodating part, and at least one second accommodating part, and the first accommodating part and the second accommodating part are both arranged on the main body unit; and one end of the lighting module is electrically connected in the first accommodating part, one end of the drive power supply is connected in the second accommodating part, and the drive power supply supplies power to the lighting module.

2. The lighting device according to claim 1, wherein the lighting module is a strip-shaped module, and at least two lighting modules, the lighting modules and the drive power supply are arranged in parallel on the chassis.

3. The lighting device according to claim 2, wherein:

each first accommodating part is provided with a conversion circuit module; and each conversion circuit module is connected with the drive power supply, a conductive terminal is arranged at one end of the lighting module, and the conversion circuit module is electrically connected with the conductive terminal.

4. The lighting device according to claim 3, wherein:

each lighting module comprises: a light source plate, a lens, and a panel;

along a direction from the chassis to the light source plate, at least one light source is electrically connected with the light source plate;

along the direction from the chassis to the light source plate, the lens is covered on the light source; and a light-through hole is arranged on the panel, the lens is arranged in the light-through hole, and the panel is used for fixing the lens on the light source plate; the conductive terminal is arranged at one end of the light source plate; and a conductive hole is arranged on the panel, and the conductive terminal passes through the conductive hole and is electrically connected with the conversion circuit module.

5. The lighting device according to claim 4, wherein:

the lens comprises a first lens element and three second lens elements, the three second lens elements are arranged in a circular array around the first lens element by taking the first lens element as a center of a circle, and light sources are respectively arranged on the light source plate below the first lens element and the three second lens elements; or/and two or more lenses, along an extension direction of the lighting module, two adjacent lenses are arranged symmetrically at 180 degrees.

6. The lighting device according to claim 3, wherein the conductive terminal is a copper elastic sheet, a metal contact is arranged on the conversion circuit module, and the copper elastic sheet is electrically connected with the metal contact.

7. The lighting device according to claim 4, wherein the lighting module further comprises: a heat dissipation element, the light source plate is arranged on the heat dissipation element, and the heat dissipation element is arranged on the chassis.

8. The lighting device according to claim 4, further comprising: at least one second mounting component connected with the panel, the second mounting component being used for fixing the other end of the lighting module.

9. The lighting device according to claim 8, wherein an elastic part is arranged inside the second mounting component, and the other end of the panel presses the lighting module on the chassis through the elastic part.

10. The lighting device according to claim 9, wherein the elastic part comprises a sliding block and a spring, one end of the spring is arranged on the second mounting component, and the other end of the spring is arranged on the sliding block; in a direction away from the spring, at least one first protrusion is arranged on one side of the sliding block, at least one first groove is arranged on one end of the panel, and the first protrusion is inserted into the first groove.

11. The lighting device according to claim 9, wherein the elastic part comprises a press fit part and a spring, one end of the spring is arranged on the second mounting component, and the other end of the spring is arranged on the press fit part; and in a direction away from the spring, a pressing-down plate is arranged on one side of the press fit part, a second protrusion is arranged on one end of the panel, and the pressing-down plate is pressed on the second protrusion.

12. The lighting device according to claim 8, wherein a second groove and a rotary pressing part are arranged on the second mounting component, a third protrusion is arranged on the other end of the lighting module, the third protrusion is inserted into the second groove in an interference fit mode, and the rotary pressing part is pressed on the third protrusion.

13. A ceiling light, comprising a lighting device and a mounting element for mounting the lighting device under a roof, wherein:

the lighting device comprises a chassis, at least one lighting module, a drive power supply, and a first mounting component;

the lighting module and the drive power supply are arranged on the chassis;

the first mounting component is configured to mount the lighting module and the drive power supply on the chassis in a covering mode, the first mounting component comprises a main body unit, at least one first accommodating part, and at least one second accommodating part, and the first accommodating part and the second accommodating part are both arranged on the main body unit; and one end of the lighting module is electrically connected in the first accommodating part, one end of the drive power supply is connected in the second accommodating part, and the drive power supply supplies power to the lighting module.

14. The ceiling light according to claim 13, further comprising: a shell, the shell is covered on the chassis, a cavity is formed between the shell and the chassis, and the lighting module and the drive power supply are arranged in the cavity.

15. A method of manufacturing a lighting device, comprising:

providing a chassis, at least one lighting module, a drive power supply, and a first mounting component;

arranging the lighting module and the drive power supply on the chassis;

configuring the first mounting component to mount the lighting module and the drive power supply on the chassis in a covering mode;

providing the first mounting component with a main body unit, at least one first accommodating part, and at least one second accommodating part;

arranging the first accommodating part and the second accommodating part on the main body unit;

electrically connecting one end of the lighting module in the first accommodating part;

connecting one end of the drive power supply in the second accommodating part; and supplying, by the drive power supply, power to the lighting module.

16. The method of claim 15, further comprising:

providing lighting module that a strip-shaped module, and arranging at least two lighting modules, the lighting modules and the drive power supply in parallel on the chassis.

17. The method of claim 16, further comprising:

providing each first accommodating part with a conversion circuit module;

connecting each conversion circuit module with the drive power supply;

arranging a conductive terminal at one end of the lighting module, and electrically connecting the conversion circuit module with the conductive terminal.

18. The method of claim 17, further comprising:

providing each lighting module with a light source plate, a lens, and a panel;

along a direction from the chassis to the light source plate, electrically connecting at least one light source with the light source plate;

along the direction from the chassis to the light source plate, covering the lens on the light source; and arranging a light-through hole on the panel, arranging the lens in the light-through hole, and using the panel for fixing the lens on the light source plate; arranging the conductive terminal at one end of the light source plate; and arranging a conductive hole on the panel, and providing the conductive terminal to pass through the conductive hole and electrically connecting the conductive terminal with the conversion circuit module.

* * * * *